US007827708B2

(12) United States Patent
Gazzola

(10) Patent No.: US 7,827,708 B2
(45) Date of Patent: Nov. 9, 2010

(54) CYCLING SHOE

(75) Inventor: Ernesto Gazzola, Coste Di Maser (IT)

(73) Assignee: Gaerne S.p.A., Maser (IT)

( * ) Notice: Subject to any disclaimer, the term of this patent is extended or adjusted under 35 U.S.C. 154(b) by 800 days.

(21) Appl. No.: 11/818,537

(22) Filed: Jun. 14, 2007

(65) Prior Publication Data

US 2008/0000110 A1 Jan. 3, 2008

(30) Foreign Application Priority Data

Jun. 16, 2006 (IT) ..... TV2006U0027

(51) Int. Cl.
*A43B 5/00* (2006.01)

(52) U.S. Cl. ..... 36/131; 36/50.1; 36/50.5

(58) Field of Classification Search ..... 36/50.1, 36/50.5, 131

See application file for complete search history.

(56) References Cited

U.S. PATENT DOCUMENTS 3,205,544 A * 9/1965 Streule et al. ..... 24/306
4,308,672 A * 1/1982 Antonious ..... 36/50.1
4,395,801 A * 8/1983 Gabrielli ..... 24/70 SK
4,642,914 A * 2/1987 Caldeira ..... 36/50.1
4,670,946 A * 6/1987 Olivieri ..... 24/71 SK
RE32,585 E * 2/1988 Antonious ..... 36/50.1
4,794,674 A * 1/1989 Mintel et al. ..... 24/712.1
4,907,352 A * 3/1990 Ginsberg ..... 36/50.1
5,495,683 A * 3/1996 Miotto et al. ..... 36/50.5
5,526,585 A * 6/1996 Brown et al. ..... 36/50.1
5,557,864 A * 9/1996 Marks ..... 36/50.1
5,572,774 A * 11/1996 Duren ..... 24/306
2004/0226189 A1* 11/2004 Semitka ..... 36/50.5
2005/0044747 A1* 3/2005 Doody ..... 36/50.1

* cited by examiner

*Primary Examiner*—Marie Patterson
(74) *Attorney, Agent, or Firm*—Frommer Lawrence & Haug LLP; Ronald R. Santucci

(57) ABSTRACT

A cycling shoe substantially defined by an appropriately shaped vamp, a rigid sole stitched and/or glued to the bottom of the vamp, and one or more Velcro-fastened straps by which to tighten the vamp and immobilize the user's foot inside the shoe; each strap having a slip ring secured stably to the vamp, close to a first lateral edge of the vamp defining the longitudinal opening for insertion of the foot; and a fastening strip, of appropriate length, which has a first end secured stably to the vamp, close to a second lateral edge of the vamp defining the longitudinal opening for insertion of the foot, and is designed to fold back on itself about an intermediate portion, so that the second end of the strip rests on one of the two faces of the strip, close to the first end of the strip.

7 Claims, 1 Drawing Sheet

CYCLING SHOE

This application claims priority benefits of Italian Utility Model Application number TV2006U 000027 filed Jun. 16, 2006, the disclosure of which is hereby incorporated by reference.

The present invention relates to a cycling shoe.

BACKGROUND OF THE INVENTION

As is known, some currently marketed cycling shoe models comprise an appropriately shaped vamp; a rigid sole stitched and/or glued to the bottom of the vamp; an arch support fixed to the sole, inside the vamp; and a number of straps by which to tighten the vamp and immobilize the user's foot inside the shoe.

More specifically, the part of a cycling shoe vamp corresponding to the instep of the foot has a longitudinal opening or slit sized to permit easy insertion of the foot inside the shoe, and the straps are spaced along the vamp, astride the longitudinal opening or slit, so that each brings together and secures locally to each other the two opposite lateral edges of the vamp laterally defining the opening, to tighten the vamp adjustably to the user's foot.

Some cycling shoe models of the above type have "Velcro-fastened" straps comprising a slip ring fixed stably to the vamp, close to one of the two lateral edges of the vamp laterally defining the longitudinal opening of the shoe; and a fastening strip, which is secured at one end to the vamp, close to the other of the two lateral edges of the vamp laterally defining the longitudinal opening of the shoe, and is designed to thread through the slip ring and fold back on itself so that one end of the strip rests on top of the other. The fastening strip also has two Velcro inserts located at the two ends of one of the two faces of the strip, and which are superimposed and adhere to each other when the strip is folded back on itself.

Because the "Velcro" fastening system fails to ensure sufficient long-term stability, some cycling shoe manufacturers have thought to fit the two Velcro inserts centrally with two small toothed plastic plates, which have a serrated profile to mesh with each other when the two Velcro inserts are superimposed, so that pull stress tangent to the plane of the fastening strip, and therefore to the surfaces of the two Velcro inserts, is transmitted directly to the two toothed plates, with no stress on the inserts.

Though successful in preventing slippage of the two ends of the fastening strip caused by pull stress, in use, tangent to the plane of the fastening strip, positioning the two toothed plates centrally on the Velcro inserts in no way counteracts parting of the two inserts caused by intrinsic "slackening" of the material.

As a result, the two toothed plates tend to part gradually until they are suddenly released, thus resulting in immediate slackening of the fastening strip caused by the pull stress tangent to the surfaces of the Velcro inserts.

SUMMARY OF THE INVENTION

It is an object of the present invention to provide a cycling shoe with "Velcro-fastened" straps, designed to eliminate the aforementioned drawbacks.

According to the present invention, there is provided a cycling shoe as claimed in the attached Claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
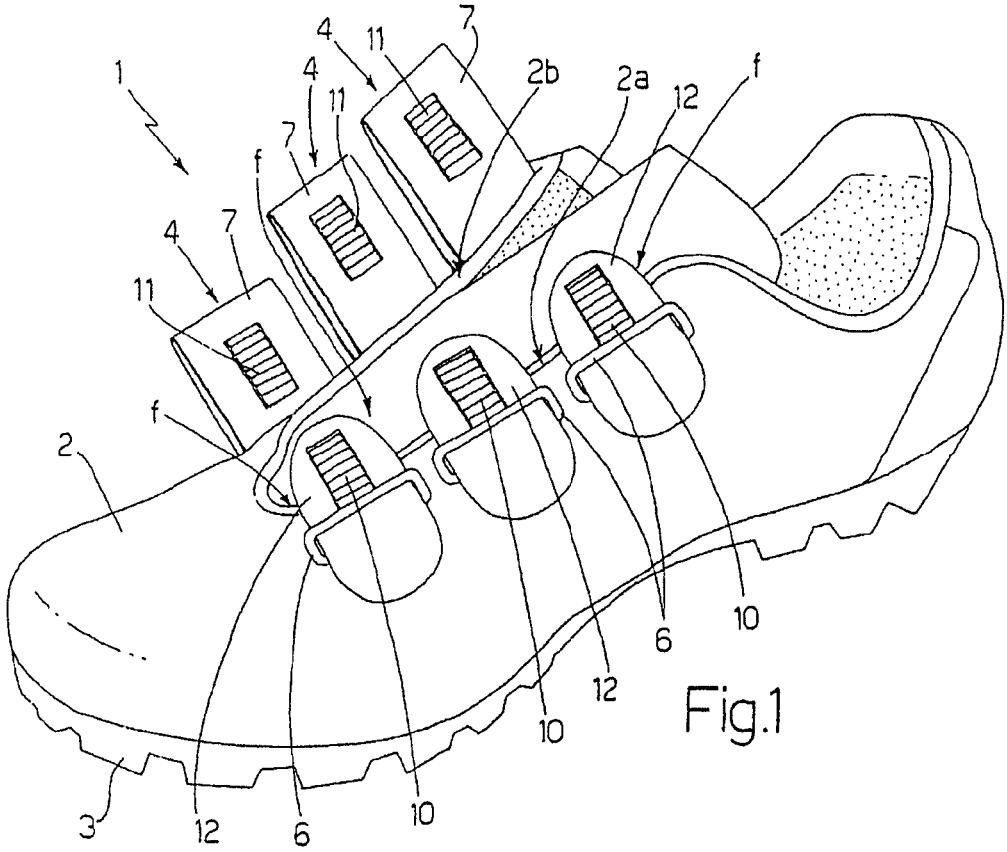
FIG. 1 shows a view in perspective, with parts removed for clarity, of a cycling shoe in accordance with the teachings of the present invention.

Number 1 in FIG. 1 indicates as a whole a cycling shoe substantially comprising an appropriately shaped vamp 2 preferably, though not necessarily, made of leather or highly transpiring synthetic fabric; a preferably, though not necessarily, rigid sole 3 stitched and/or glued to the bottom of vamp 2; an arch support (not shown) fixed to the surface of sole 3 facing the inside of vamp 2; and one or more straps 4, by which to tighten vamp 2 to immobilize the user's foot inside shoe 1.

More specifically, vamp 2 is designed to form, in the part of shoe 1 corresponding to the instep of the foot, a longitudinal opening or slit f sized to permit easy insertion of the foot inside shoe 1; and straps 4 are spaced along vamp 2, astride longitudinal opening or slit f, so that each brings together and secures locally to each other the two opposite lateral edges 2*a*, 2*b* of vamp 2 laterally defining longitudinal opening or slit f, to tighten vamp 2 adjustably to the user's foot.

Figure 2:
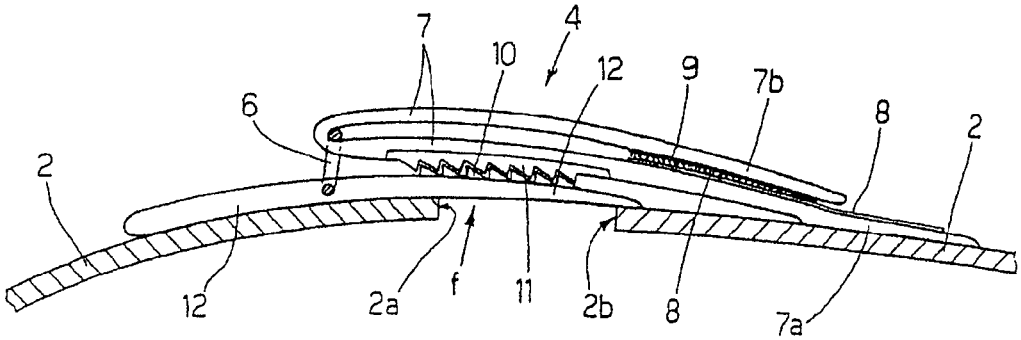
FIG. 2 shows a detailed section of the top of the FIG. 1 cycling shoe.

With reference to FIGS. 1 and 2, in the example shown, shoe 1 comprises three straps 4 appropriately spaced on vamp 2 along the whole length of longitudinal opening f, and each comprises a slip ring 6 secured stably to vamp 2, close to lateral edge 2*a* of vamp 2; and a fastening strip 7, of appropriate length, which has a first end 7*a* secured stably to vamp 2, close to lateral edge 2*b* of vamp 2, and aligned with the corresponding slip ring 6, and is designed to fold back on itself about an intermediate portion, so that the second end 7*b* of strip 7 rests on one of the two faces of strip 7, close to first end 7*a* of strip 7.

Each strap 4 also comprises two complementary Velcro inserts 8 and 9, which are fixed stably to the body of strip 7, close to first end 7*a* and second end 7*b* of strip 7 respectively, so they are superimposed and adhere to each other when strip 7 is folded back on itself with second end 7*b* of strip 7 resting on first end 7*a* of strip 7.

More specifically, in the example shown, Velcro inserts 8 and 9 are stitched or glued to the two ends of the same face of strip 7.

With reference to FIGS. 1 and 2, unlike known cycling shoes, each strap 4 also comprises two small, substantially rectangular toothed plates 10 and 11 made preferably, though not necessarily, of plastic or metal, and which are superimposed and mesh with each other when strip 7 is threaded through slip ring 6 with its intermediate portion resting on slip ring 6.

More specifically, toothed plate 10 is secured stably to vamp 2, between slip ring 6 and lateral edge 2*a* of vamp 2 close to slip ring 6; and toothed plate 11 is secured stably to the face of strip 7 locally facing toothed plate 10 when strip 7 is threaded through slip ring 6 with its intermediate portion resting on slip ring 6. In other words, toothed plate 11 is secured stably to the face of strip 7, which, along a small portion, faces vamp 2 and longitudinal opening f, i.e. to the face opposite that fitted with the two Velcro inserts 8 and 9.

With reference to FIGS. 1 and 2, in the example shown, toothed plate 10 is formed in one piece on a rigid supporting flap 12, which is preferably, though not necessarily, made of plastic or metal, is stitched or glued stably to vamp 2, projects from lateral edge 2*a* of vamp 2 towards lateral edge 2*b* of vamp 2, and is positioned underneath strip 7 when strip 7 is threaded through slip ring 6 with its intermediate portion resting on slip ring 6.

In addition to the above, in the example shown, slip ring 6 of each strap 4 is fixed directly to rigid supporting flap 12, alongside corresponding plate 10, but may obviously even be fixed to vamp 2 independently of toothed plate 10.

Operation of cycling shoe 1 will be clear from the foregoing description, with no further explanation required.

The advantages of cycling shoe 1 are obvious: by virtue of the particular location of the two toothed plates 10 and 11, pull along strip 7 tends to keep toothed plate 11 resting on toothed plate 10, even when the connection between the two Velcro inserts 8 and 9 "slackens" and looses grip.

In which case, in fact, second end 7*b* of strip 7 still tends to come away from the face of strip 7, but slip ring 6 still keeps toothed plate 11 of strip 7 resting on toothed plate 10 of vamp 2, thus preventing the two lateral edges 2*a* and 2*b* of vamp 2 laterally defining longitudinal opening or slit f from loosening and so opening shoe 1.

Clearly, changes may be made to cycling shoe 1 as described and illustrated herein without, however, departing from the scope of the present invention.

The invention claimed is:

1. A cycling shoe comprising an appropriately shaped vamp, and a sole fixed to the bottom of said vamp; said vamp being designed to form, in the part corresponding to the instep of the foot, a longitudinal opening (f), for insertion of the foot, defined laterally by two opposite lateral edges of the vamp; said cycling shoe also comprising at least one strap located on the vamp, astride said longitudinal opening (f), to selectively bring together and locally secure to each other said two opposite lateral edges of the vamp laterally defining said longitudinal opening (f); said at least one strap comprising a slip ring secured stably to the vamp, close to a first lateral edge of the two opposite lateral edges of the vamp laterally defining said longitudinal opening (f), and a fastening strip, which has a first end secured stably to the vamp, close to the second lateral edge of the two opposite lateral edges of the vamp laterally defining said longitudinal opening (f), and is designed to fold back on itself about an intermediate portion, so that the second end of the strip rests on the body of the strip, close to the first end of the strip; said strap also comprising two complementary hook and loop fastener inserts fixed stably to the body of the strip, one close to the first end of the strip and the other close to the second end of the strip, so as to be superimposed and adhere to each other when the strip is folded back on itself;

wherein at least one strap comprises a first and a second toothed plate, which are superimposed and mesh with each other when said strip is threaded through the slip ring with its intermediate portion resting on said slip ring; said first toothed plate being secured stably to the vamp, between the slip ring and said first lateral edge of the vamp close to the slip ring; and said second toothed plate being secured stably to the face of the strip locally facing the first toothed plate when the strip is threaded through the slip ring with its intermediate portion resting on said slip ring.

2. A cycling shoe as claimed in claim 1, wherein said at least one strap comprises a rigid supporting flap, which is secured stably to the vamp, projects from the first lateral edge of the vamp towards the second lateral edge of the vamp, and is positioned underneath the strip when the strip is threaded through the slip ring with its intermediate portion resting on the slip ring; said first toothed plate being formed in one piece on said rigid supporting flap.

3. A cycling shoe as claimed in claim 2, wherein said rigid supporting flap is made of plastic or metal.

4. A cycling shoe as claimed in claim 2, wherein said slip ring is fixed to said rigid supporting flap, alongside the first toothed plate.

5. A cycling shoe as claimed in claim 1, wherein said two hook and loop fastener inserts are stitched or glued to the same face of the strip, at the two ends of the strip.

6. A cycling shoe as claimed in claim 5, wherein said second toothed plate is secured stably to the opposite face of the strip to that fitted with said two hook and loop fastener inserts.

7. A cycling shoe as claimed in claim 1, wherein said sole is rigid.

* * * * *